United States Patent [19]

Sakuraya et al.

[11] 4,436,287

[45] Mar. 13, 1984

[54] METHOD FOR PROTECTING TUYERES FOR REFINING A MOLTEN IRON

[75] Inventors: Toshikazu Sakuraya; Hideo Nakamura; Nobuo Harada; Tetsuya Fujii; Toshihiko Emi, all of Chiba, Japan

[73] Assignee: Kawasaki Steel Corporation, Kobe, Japan

[21] Appl. No.: 511,511

[22] Filed: Jul. 6, 1983

[30] Foreign Application Priority Data

| | | | |
|---|---|---|---|
| Jul. 12, 1982 | [JP] | Japan | 57-120961 |
| Jul. 12, 1982 | [JP] | Japan | 57-120962 |
| Jul. 12, 1982 | [JP] | Japan | 57-120963 |
| Jul. 12, 1982 | [JP] | Japan | 57-120964 |

[51] Int. Cl.[3] ..... C21B 7/16

[52] U.S. Cl. ..... 266/47; 75/60

[58] Field of Search ..... 266/47, 222, 268, 46, 266/225; 75/60

[56] References Cited

U.S. PATENT DOCUMENTS

| | | | |
|---|---|---|---|
| 3,201,226 | 8/1965 | Spolders et al. | 75/60 |
| 4,330,108 | 5/1982 | Nakanishi et al. | 266/47 |

FOREIGN PATENT DOCUMENTS

| | | | |
|---|---|---|---|
| 1486539 | 11/1977 | United Kingdom | 266/222 |

*Primary Examiner*—L. Dewayne Rutledge
*Assistant Examiner*—Robert L. McDowell
*Attorney, Agent, or Firm*—Balogh, Osann, Kramer, Dvorak, Genova & Traub

[57] ABSTRACT

Wear of tuyeres for refining a molten iron is prevented by blowing a CO-containing gas having the defined flow amount, oxygen gas flow amount and CO gas concentration as a shrouding gas which surrounds a core refining gas flow containing oxygen gas through tuyeres of concentric pipes. As the shrouding gas for cooling and protecting the tuyeres, use may be made of an exhaust gas discharged and recovered from a converter or a blast furnace by controlling the concentrations of CO and $N_2$ in the exhaust gas to the specific limitations.

8 Claims, 6 Drawing Figures

METHOD FOR PROTECTING TUYERES FOR REFINING A MOLTEN IRON

BACKGROUND OF THE INVENTION

1. Field of the Invention

The present invention relates to a method for protecting tuyeres for refining molten iron and is a novel proposal of results obtained by conducting a variety of studies and experiments with respect to a protecting fluid in the annulus of concentric tuyeres used for blowing a refining gas flow consisting of oxygen or a gas containing at least oxygen in a bottom-blown or a top-and-bottom-blown converter and the like.

2. Description of the Prior Art

As the protecting fluids of the double jet pipe tuyeres for refining molten iron, hydrocarbon gases used in oxygen bottom-blown converter usually known as OBM/Q-BOP, for example, propane, butane, natural gas and the like, or kerosene used in a bottom-blown converter usually known as LWS have been heretofore well known. These already known protecting fluids flow in such a state that these fluids surround the oxidizing gas, particularly pure oxygen gas constituting an axial core flow of the above described tuyere in a shrouding form, whereby it has been attempted to prolong the durable life of the tuyere owing to the cooling function of the shrouding gas. However, the above described protecting fluids contain hydrogen atom and a part of said hydrogen is absorbed in the molten iron and adversely affects upon the quality of the product.

In the bottom-blown converter for refining stainless steel usually known as AOD, protecting fluids containing no hydrogen atom, such as an inert gas, particularly argon gas or nitrogen gas are used, but these gases are not thermally decomposed at high temperatures, so that these gases do not show the heat removing effect which satisfactorily cools the tip of the tuyere opening at the molten iron bath side and the durable life of the tuyere is not greater than 350 heats and is inferior to the above described OBM/Q-BOP, which is greater than 1,000 heats.

Other than the above described protecting fluids, it has been already well known to use gaseous or liquid carbon dioxide as the protecting fluid containing no hydrogen. For example, gaseous carbon dioxide is disclosed in Japanese Pat. No. 447,093 (Japanese Patent Application Publication No. 24,183/1964). Liquid carbon dioxide is disclosed in Rev. Metallurgie (1978), P. 13~19. However, the cooling effect of carbon dioxide relies only upon the same small effect of removing heat as in argon gas or nitrogen gas, because no decomposition reaction is caused different from hydrocarbons and kerosene. If an explanation is made with reference to propane used as a hydrocarbon heretofore, it has been known from experiment that the tuyere can be satisfactorily protected by supplying about 4% by volume based on oxygen gas in the axial core flow of the tuyere. The effect of said propane for removing heat is attained by two factors. One factor is sensible heat variation when propane gas is raised from room temperature to 1,600° C. which is the temperature of the molten iron bath and another factor is heat removal owing to endothermic reaction when propane, $C_3H_8$ is decomposed at high temperature into C and $H_2$. The sum of the above described two endothermic amounts calculated by the well known thermodynamic constant is about 78 Kcal/mol. While in the case of gaseous carbon dioxide, the decomposition reaction does not occur even if the heating is effected up to 1,600° C., and the tuyere is cooled only by the variation of sensible heat amount when carbon dioxide at room temperature is heated to 1,600° C. Therefore, an amount of heat removed by gaseous carbon dioxide is calculated to be 18.4 Kcal/mol. Similarly, the endothermic amount when liquid carbon dioxide is used, is 21.5 Kcal/mol when the calculation is effected by using the well known thermodynamic constant and this value is not greatly different from the above described value of gaseous carbon dioxide. Accordingly, in order to obtain the same cooling effect as in 4% by volume based on oxygen of propane by using carbon dioxide, carbon dioxide corresponding to 15~17% by volume based on oxygen of gaseous carbon dioxide is necessary. However, if such a large amount of carbon dioxide must be used, even if the problem of hydrogen pick-up which has been a defect in view of quality, is solved, such a means is not only more expensive than the already known propane, but also the heat balance in the converter is greatly worsened and it is difficult to obtain the same blow finishing temperature unless iron ore is reduced by 25 kg/ton molten steel as compared with the usual blowing. This means that cheap iron ore cannot be used as iron source and hence iron yield is lowered.

Furthermore, carbon dioxide is an oxidizing gas and therefore damages magnesia carbon bricks around the tuyeres and the durable life of the refractory is lowered.

As mentioned above, the idea in which carbon dioxide is used as the protecting fluid has been already proposed but this cannot compete with the conventional method using propane in view of economy, so that carbon dioxide has not been commercially practically used.

In Japanese Patent Application Publication No. 48,568/1980, there is disclosed that regarding the above described OBM process, carbon monoxide is usd as the protecting fluid other than the above described hydrocarbons, rare gas and carbon dioxide but the practical use is limited to the above described propane. Furthermore, Japanese Patent Laid-open Specification No. 93,814/1981 discloses that "the exhaust gas recovered from the bottom-blown refining furnace in the unburnt form" is used as the cooling medium but this prior art mainly aims the utilization of carbon dioxide in the exhaust gas and the cooling function of carbon monoxide which is the major part of volume of the exhaust gas, is neglected and rather there is mentioned that carbon monoxide is not desirable. In fact, the cooling action of carbon monoxide has not been taken into consideration.

SUMMARY OF THE INVENTION

The inventors have tried to protect the tuyeres by using carbon monoxide and found that the effective activity for cooling and protecting the tuyeres can be advantageously obtained under an appropriate flow rate of carbon monoxide gas based on a flow amount of the refining gas in a level comparable with a hydrocarbon gas without causing the pick-up of hydrogen which is the greatest defect when using the hydrocarbon.

The present invention is based on such a discovery and aims to prolong the durable life of the refining vessels in a low cost by reducing the wear of the tuyeres for refining a molten iron without increasing the concentration of hydrogen in steel.

BRIEF DESCRIPTION OF THE DRAWINGS

The present invention will now be described in detail with reference to the accompanying drawings, wherein.

and

Figure 6:
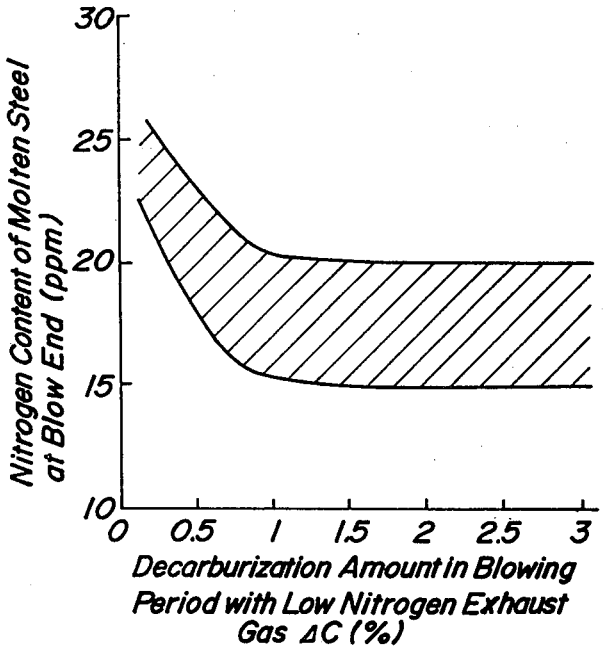

FIG. 6 is a graph showing a relation between the decarburization amount $\Delta C$ in the blowing period using lownitrogen exhaust gas of the converter according to the present invention and the nitrogen content in molten iron at blow end.

DESCRIPTION OF THE PREFERRED EMBODIMENTS

The present invention can be applied to any vessels for refining a molten iron wherein the above described tuyeres are used for blowing a refining gas into a molten iron bath, for example, a bottom-blown converter, a top-and-bottom-blown converter, an electric furnace or an open hearth furnace, or AOD process. Molten irons include iron-carbon molten metal, which is mainly molten iron of blast furnace, iron-carbon molten metal in an electric furnace wherein scrap is melted and high alloy iron-carbon molten metal to be used in refining in AOD process, the main raw material of which is high alloy scrap.

Tuyeres for refining molten iron to be used in the present invention are already known concentric tuyeres and a refining gas consisting of oxygen or a gas containing oxygen is blown into the molten iron bath through an inner pipe of the concentric tuyere and a shrouding gas which acts to cool and protect the tips of the tuyeres is blown into the molten iron bath through a gap between the inner pipe and the outer pipe.

As mentioned above, the present invention is based on the discovery that carbon monoxide acts the function for cooling and protecting the tuyeres which can be compared with the prior propane, without causing the defect of the pick-up of hydrogen which is inevitable to the use of propane.

It has been found that the object of the present invention can be attained by supplying the shrouding gas flow containing CO in a rate satisfying the following equation $$q_c \geqq 4.8 q_o / x$$

wherein $q_c$ is a flow amount ($Nm^3/hr$) of the shrouding gas containing CO, $q_o$ is a flow amount ($Nm^3/hr$) of oxygen supplied from the inner pipe and x is a concentration of CO in the shrouding gas.

As already mentioned, when carbon dioxide is used as the shrouding gas, the amount of $CO_2$ used must be greatly increased as compared with the amount of propane used, while when the shrouding gas containing CO is used, it is not necessary to increase said gas as in the case of $CO_2$, so that a variety of defects owing to the use of the excessive amount of cooling gas are not caused.

Thus, the substantially equal or more effect for prolonging the durable life of the tuyeres than the case using propane as the cooling gas can be conveniently and easily obtained by using CO-containing gas as the cooling gas without causing any disadvantages of increase of the hydrogen content in the molten steel bath, of increase of the cost and of decrease of the iron yield due to increase of the amount of the cooling gas used.

The mechanism why the melting wear of the tuyeres can be noticeably reduced by using carbon monoxide is considered to be as follows.

A mushroom consisting of a porous solidified iron is formed on a gap between the inner pipe and the outer pipe of the tuyere by flowing out of CO-containing shrouding gas surrounding the jet flow of the oxidizing gas as in the usual manner but when the shrouding gas flow passes through the pores in the mushroom, a reaction of the following formula (1) proceeds rightwardly and a large amount of powdery carbon is precipitated.

$$2CO \rightleftarrows C(S) + CO_2 \quad (1)$$

This powdery carbon is entrapped in the shrouding gas flow and enters into molten iron and causes an endothermic reaction shown by the following formula (2) with iron oxide (FeO) formed in the reaction of oxygen ($O_2$) passed through the inner pipe of the tuyere with molten iron and the circumference of the tip of the tuyere is effectively cooled by this reaction heat.

$$C(S) + FeO \rightarrow Fe + CO \quad (2)$$

In addition, the blowing CO gas brings about the following merit. FeO formed in a large amount by blowing $O_2$ gas into the molten iron bath reacts with the refractory around tip of the tuyere to lower the melting point thereof and there is fear that said refractory is melted and damaged by the molten iron at high temperature but when CO gas is blown, a reaction shown by the following formula (3) occurs and FeO is reduced and the concentration of FeO around the tip of the tuyere is advantageously lowered.

$$FeO + CO \rightarrow Fe + CO_2 \quad (3)$$

The use of CO gas provides an additional merit. $CO_2$ used in the prior art is oxidizing and magnesia carbon bricks or magnesia dolomite carbon bricks which are useful as the refractories for bottom of a bottom-blown converter, are oxidized and damaged due to the oxidation by $CO_2$, while CO is reducing, so that such refractories are not damaged and in this point, the use of CO gas is also advantageous.

In order to reduce the melting wear of the tuyeres and the refractories around the tuyeres and to satisfactorily precipitate powdery carbon based on the reaction of the above described formula (1) to improve the function for protecting the tuyeres by utilizing the endothermic reaction of the above described formula (2), it is advantageous that the concentration of CO in the shrouding gas is higher.

Therefore, it is preferable to use CO gas having a high concentration, for example, pure CO gas but this is very expensive and is reverse to the object of the present invention that reduces the cost of the product. If an exhaust gas which is easily available in an iron-making factory, contains a large amount of CO and is recovered from refining vessels, such as a converter in an unburnt form, can be directly used, this is very advantageous in view of cost but when the exhaust gas of the converter is recovered in the unburnt form, it is not avoidable to admix air and therefore, a fairly large amount of $CO_2$ is admixed in the exhaust gas of the converter as shown in Table 1.

TABLE 1

| CO | $CO_2$ | $N_2$ | (%) $H_2$ |
|---|---|---|---|
| 60–80 | 15–20 | 10–20 | 0–5 |

When such an exhaust gas of the converter wherein CO and $CO_2$ are admixed, is used, if an amount of $CO_2$ is larger as compared with that of CO, since the reaction of the above described formula (1) is a reversible reaction, the reaction directing to the right side in the formula (1) which precipitates the powdery carbon, does not occur and the cooling of the tuyeres relies only upon the variation of sensible heat of the shrouding gas.

The inventors have diligently studied the ratio of CO to $CO_2$ in the shrouding gas by which the powdery carbon is precipitated and the cooling and protection of the tuyeres can be efficiently attained and the following discovery has been obtained.

It is considered that the reaction for precipitating carbon in the formula (1) occurs when the shrouding gas passes through pores in the mushroom formed at the tip of the tuyere and therefore, when the temperature of the mushroom in usual refining is measured, it has been found that said temperature is not higher than 900° C. except for the most surface layer portion and that in order to satisfactorily progress the reaction of the above described formula (1) toward the right side at such a temperature, the ratio of the concentration of $CO_2$ in the shrouding gas to that of CO is equal to or less than 1/10 according to the well known thermodynamic analysis. In fact, when the exhaust gas wherein both the gas components are adjusted as follows as mentioned hereinafter, is used, the satisfactory effect for cooling and protecting the tuyeres can be obtained.

That is, the object of the present invention can be obtained by supplying as the shrouding gas the exhaust gas containing a large amount of CO, which is discharged and recovered from a refining vessel in an unburnt form, in which $CO_2$ is removed so as to satisfy the following equation $$C_{CO_2} \leqq 1/10 C_{CO}$$

in which $C_{CO_2}$ shows a concentration (%) of $CO_2$ in the shrouding gas and $C_{CO}$ shows a concentration (%) of CO in the shrouding gas.

As the exhaust gas discharged from the refining vessels, the exhaust gas from a converter is advantageous in view of the easy availability and the concentration of CO and as the means for removing $CO_2$ from the exhaust gas, the well known deep cooling separation process and the absorption process using an aqueous solution of $K_2CO_3$ may be used.

When the exhaust gas discharged and recovered from the refining vessels in the unburnt form is used as the shrouding gas, a relatively large amount of $N_2$ may be contained as shown in Table 1. When such a gas is directly used as the shrouding gas, the nitrogen content in the molten iron is raised and there is fear that the quality of the produced steel is deteriorated.

The inventors have made a large number of experiments and studies by using the exhaust gas recovered from a converter in the unburnt form in which $N_2$ is adsorbed and removed through an adsorbing tower for $N_2$ and adjusted into various concentrations of $N_2$ and it has been found that the nitrogen content in the molten iron depends upon the concentration of $N_2$ in the shrouding gas and the flow amount of the shrouding gas and that in order to prevent the substantial increase of the nitrogen content in the molten iron, the upper limit of the concentration of $N_2$ in the shrouding gas can be defined by the flow amount of the bottom-blown $O_2$ gas based on the total flow amount of the top-and-bottom-blown $O_2$ gas. Thus, the efficient cooling and protection of the tuyeres can be advantageously attained in the same level of the nitrogen content in the molten iron as the case using the hydrocarbon gas without increasing the nitrogen content.

Such an object of the present invention can be attained by controlling the concentration $C_N(\%)$ of $N_2$ in the shrouding gas so as to satisfy the following equation $$C_{N_2} \leqq 2.5 q_o / q_o^B$$

wherein $q_o$ is the total flow amount of the refining $O_2$ gas and $q_o^B$ is a flow amount of $O_2$ gas supplied from the tuyeres.

The removal of $N_2$ gas from the exhaust gas recovered from the converter in the unburnt form needs a treating step for removing $N_2$ in which the exhaust gas is introduced into an adsorbing tower filled with an adsorbant under pressure, but this removal of $N_2$ is expensive. Accordingly, it is not desirable in view of cost to use the exhaust gas of the converter to which the treatment for removing $N_2$ has been subjected over the entire period of the refining.

Thus, the inventors have made studies with respect to the period for which the low $N_2$-containing exhaust gas of the converter is used for preventing the increase of the nitrogen content in the molten iron, aiming to reduce the cost required for the treatment for removing nitrogen. It has been found that in general, when the emission of CO gas is vigorous at an initial stage of blowing, the effect of degasing is high, so that even if nitrogen gas is blown into the molten iron, the blown nitrogen gas is discharged off from the bath, so that nitrogen is not substantially absorbed into the molten iron. Thus, it is not necessary to particularly use the low $N_2$-containing exhaust gas from the initial blowing stage to the middle blowing stage and it is desirable in order to improve the quality of the produced steel to use the exhaust gas to which the treatment for removing nitrogen is subjected at the terminal stage of blowing.

The exhaust gas containing a relatively large amount of CO, which is easily available in iron making factories includes an exhaust gas of a blast furnace other than the exhaust gas of the converter. If such an exhaust gas of a blast furnace is used, this is very advantageous in view of cost but in the exhaust gas of the blast furnace, carbon dioxide having a concentration following to Boudouard reaction equilibrium in the blast furnace and nitrogen contained in air blown from the tuyeres are admixtured as shown in the following Table 2.

TABLE 2

| CO | $CO_2$ | $N_2$ | (%) $H_2$ |
|---|---|---|---|
| 20–30 | 5–25 | 40–60 | 0.5–5 |

When the exhaust gas of the blast furnace containing a relatively large amount of $CO_2$ and $N_2$ as compared with the exhaust gas of converter as seen from the comparison of Table 1 with Table 2 is directly used as the shrouding gas, it has been found that the following problems occur as in the case of the exhaust gas of the converter as described above.

That is, when $CO_2$ amount is larger than CO amount, the reaction of the above described formula (1) is a reversible reaction, so that the reaction directing to the right side of the formula (1) in which powdery carbon is precipitated, does not occur and the cooling and protection of the tuyeres relies only upon the variation of the sensible heat of the shrouding gas and the effect is poor and the nitrogen content in the molten iron when the blowing is completed, is noticeably increased, so that the quality of the steel is deteriorated.

The inventors have continued the diligent study in order to solve the above described problem when the exhaust gas of the blast furnace is used, and it has been found that the exhaust gas of the blast furnace also can be used for attaining the object of the present invention, if the requirements mentioned hereinbefore in the case of the exhaust gas of the converter are satisfied.

The present invention will be described with respect to the following examples on the protecting performances of tuyeres.

Figure 1:
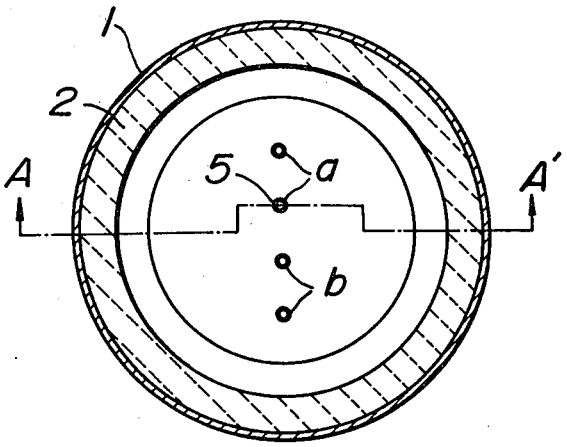
FIG. 1 is a transversal cross-sectional view of a bottom surface of an oxygen bottom-blown converter.
Figure 2:
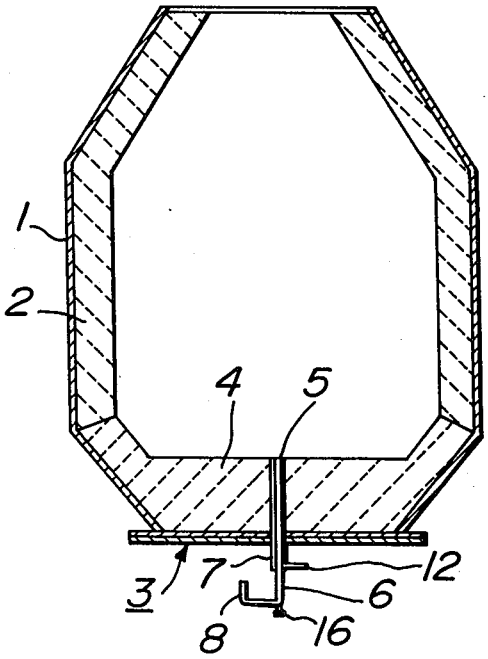
FIG. 2 is a longitudinal cross-sectional view taken along the line A–A' in FIG. 1.
Figure 3:
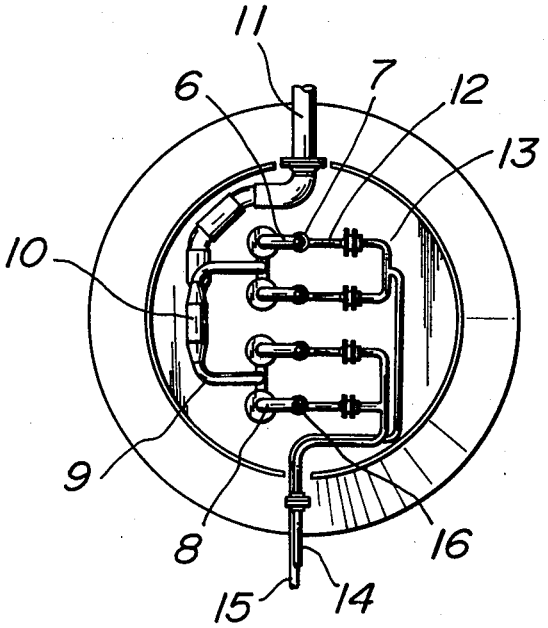
FIG. 3 is a bottom plan view of the back side of the converter in FIG. 1.

In these examples, there was an oxygen bottom-blown converter of 5 ton capacity as shown in FIGS. 1–3, wherein a sidewall of a steel shell 1 was lined with high-temperature fired magnesia-dolomite bricks 2 and a bottom portion 3 of the converter was lined with magnesia-carbon bricks 4. Four concentric tuyeres 5 were arranged in a line parallel to a tranion axis (not shown).

In the concentric tuyere, a copper pipe having an inner diameter of 8 mm and an outer diameter of 12.7 mm was used as an inner pipe 6 for flowing a refining oxygen gas (hereinafter referred to as $O_2$ gas), while a copper pipe having an inner diameter of 13.7 mm and an outer diameter of 19.05 mm was used as an outer pipe 7 for flowing a protective shrouding gas, so that an annular gap between the inner pipe 6 and the outer pipe 7 was 0.5 mm.

As shown in FIGS. 2 and 3, the inner pipe 6 was connected to a pipe 11 for feeding $O_2$ gas through a piping 8, a branch pipe 9 and a header 10, while the outer pipe 7 was connected to double pipes 14, 15 for feeding the shrouding gas through a piping 12 and a branch pipe 13. Moreover, the pipes 11, 14 and 15 were changeably connected to a nitrogen or inert gas source (not shown) required for matching to static pressure of molten iron bath at a non-blowing step, for example, during the tilting of the converter.

EXAMPLE 1

Into the converter as described above was charged a molten pig iron having the following chemical composition on weight ratio:

| | | | |
|---|---|---|---|
| C: | 4.5%, | Si: | 0.36%, |

-continued

| | | | |
|---|---|---|---|
| Mn: | 0.45%, | P: | 0.11%, |
| S: | 0.03%. | | |

The temperature of the molten pig iron was 1,270° C.

During the charging, nitrogen gas was flowed into each of the tuyeres 5 at an amount of 1.25 $Nm^3$/min in case of the inner pipe 6 and 0.23 $Nm^3$/min in case of the outer pipe 7 in order to prevent the clogging of these pipes. Immediately after the charging, the converter was turned in the perpendicular state and the blowing was performed as follows.

In the tuyeres 5, 1.25 $Nm_3$/min of $O_2$ gas was supplied to the inner pipe 6. On the other hand, 0.125 $Nm^3$/min of CO gas corresponding to 10% of the flow amount of $O_2$ gas was supplied to each of the two inner pipes 7 in a-group tuyeres 5, while 0.05 $Nm^3$/min of propane gas was supplied to each of the two inner pipes 7 in b-group tuyeres 5. Further, a top-blown lance was inserted into the converter, through which 5 $Nm^3$/min of $O_2$ gas was blown to the bath surface of molten pig iron to supplement the amount of $O_2$ gas blown from the bottom. At the same time as starting the blowing, 150 kg of burnt lime was added from the top to molten pig iron. The blowing was continued for about 20 minutes.

Thereafter, the lance was pulled up from the converter and at the same time the blowing in the each tuyere 5 was changed to the feeding of $N_2$ gas as described above. Subsequently, the converter was inclined to the charging side to conduct the measurement of molten steel temperature and the sampling, whereby the following results were obtained:

| | | | |
|---|---|---|---|
| C: | 0.03%, | Mn: | 0.23%, |
| Si: | trace, | P: | 0.017%, |
| S: | 0.018%, | | |
| Molten steel temperature: 1,646° C. | | | |

Then, the converter was inclined to a tapping side and molten steel was taken out to a ladle, after which the converter was again inclined to the charging side to remove molten slag. Thus, after the converter was emptied and the feeding of $N_2$ gas was stopped, an inspection plug 16 located just beneath the inner pipe as shown in FIGS. 2 and 3 was removed to measure the amount of tuyere wear. As a result, the amount of tuyere wear in the a-group tuyeres using CO gas according to the present invention was 1.5 mm and 1.8 mm on one charge, while the amount of tuyere wear in the b-group tuyeres using the propane gas was 2.3 mm.

The amount of tuyere wear was represented by an average value of the values measured at six points on the circumferential contour of the inner pipe 6.

From the above experiment, it has been found that the effect of preventing the tuyere wear is considerably excellent in the above amount of CO gas used as compared with the usual amount of propane gas used.

Then, various runs were made with respect to the amount of CO gas used capable of realizing the protection performance equal to that of propane gas. In these runs, the blowing operation through all tuyeres was carried out by changing the concentration of CO in the shrouding gas inclusive of Ar gas within a range of 40% to 100%, wherein the same procedure as described above was continuously repeated by 5 charges every the predetermined CO concentration, provided that the ratio of the flow amount of CO gas to the flow amount of $O_2$ gas was maintained at 10% in the run Nos. 1–4 and the flow amount of the shrouding gas per tuyere was maintained at 0.15 $Nm^3$/min in the run Nos. 5–8. Thereafter, the amount of tuyere wear was measured to obtain a result as shown in the following Table 3. For the reference, the above result using the propane gas is also shown in Table 3.

TABLE 3

| Run No. | Kind of shrouding gas | CO concentration (%) | Flow amount of shrouding gas per tuyere ($Nm^3$/min) | Flow amount of CO in shrouding gas ($Nm^3$/min) | Ratio of flow amount of CO to flow amount of $O_2$ (%) | Amount of tuyere wear (mm/charge) | Remarks |
|---|---|---|---|---|---|---|---|
| 1 | A | 100 | 0.125 | 0.125 | 10 | 1.7 | good |
| 2 | B | 80 | 0.156 | 0.125 | 10 | 1.5 | good |
| 3 | C | 60 | 0.208 | 0.125 | 10 | 1.6 | good |
| 4 | D | 40 | 0.313 | 0.125 | 10 | 1.5 | good |
| 5 | A | 100 | 0.15 | 0.15 | 12 | 1.6 | good |
| 6 | B | 80 | 0.15 | 0.12 | 9.6 | 1.7 | good |
| 7 | C | 60 | 0.15 | 0.09 | 7.2 | 1.8 | good |
| 8 | D | 40 | 0.15 | 0.06 | 4.8 | 2.7 | slightly poor |
| | propane | — | 0.05 | — | — | 2.3 | |

As apparent from the data of the run Nos. 1–4, when the flow amount of CO in the shrouding gas is 10% to the flow amount of $O_2$ gas, the effect of preventing the tuyere wear becomes fairly improved as compared with the case of using the propane gas in spite of the change of CO concentration in the shrouding gas. Furthermore, as apparent from the data of the run Nos. 5–8, the effect of preventing the tuyere wear, which is at least equal to that of the propane gas, is ensured by limiting the flow amount of CO in the shrouding gas to not less than 4.8% of the flow amount of $O_2$ gas.

Moreover, the hydrogen content of molten steel sampled at the blow end was 1.6 ppm in each of the run Nos. 1–8 according to the present invention and about 4.5±1.2 ppm in the case of using the propane gas.

EXAMPLE 2

Into the illustrated converter was charged 5 tons of molten pig iron having the following chemical composition:

| | | | |
|---|---|---|---|
| C: | 4.6%, | Si: | 0.45%, |
| Mn: | 0.12%, | P: | 0.10%, |
| S: | 0.03%. | | |

The temperature of molten pig iron was 1,290° C.

During the charging, nitrogen gas was flowed into each of the tuyeres 5 at an amount of 3.5 $Nm^3$/min in case of the inner pipe 6 and 0.35 $Nm^3$/min in case of the outer pipe 7 in order to prevent the clogging of these pipes. Immediately after the charging, the converter was turned in the perpendicular state and the blowing was performed as follows.

In the tuyeres 5, 3.5 $Nm^3$/min of $O_2$ gas was supplied to the inner pipe 6. On the other hand, an exhaust gas of the converter having an adjusted ratio of $CO_2/CO$ of 10.2 was supplied at an amount of CO of 0.35 $Nm^3$/min to each of the two inner pipes 7 in a-group tuyeres 5, while 0.15 $Nm^3$/min of propane gas was supplied to each of the two inner pipes 7 in b-group tuyeres 5. At the same time as starting the blowing, 150 kg of burnt lime was added from the top to molten pig iron. The blowing was continued for 16 minutes.

Thereafter, the blowing in the each tuyere 5 was changed to the feeding of $N_2$ gas as described above. Subsequently, the converter was inclined to the charging side to conduct the measurement of molten steel temperature and the sampling, whereby the following results were obtained:

| | | | |
|---|---|---|---|
| C: | 0.03%, | Mn: | 0.09%, |
| Si: | trace, | P: | 0.013%, |
| S: | 0.015%, | | |

Molten steel temperature: 1,657° C.

Then, the converter was inclined to a tapping side and molten steel was taken out to a ladle, after which the converter was again inclined to the charging side to remove molten slag. Thus, after the converter was emptied and the feeding of $N_2$ gas was stopped, the inspection plug 16 located just beneath the inner pipe was removed to measure the amount of tuyere wear in the same manner as described in Example 1. As a result, the amount of tuyere wear in the a-group tuyeres using the converter exhaust gas according to the present invention was 1.7 mm and 1.9 mm on one charge, while the amount of tuyere wear in the b-group tuyeres using the propane gas was 2.3 mm.

As apparent from the above, when the converter exhaust gas having the regulated concentration of $CO_2$ is used as the shrouding gas, the effect of preventing the tuyere wear is fairly excellent as compared with the case of using propane gas at the usual amount.

Then, the following experiment was made with respect to the ratio of $CO/CO_2$ in the converter exhaust gas capable of realizing the protection performance equal to that of the propane gas. That is, the converter exhaust gas having a chemical composition of 65%CO—15%$CO_2$—18%$N_2$—2%$H_2$ was passed through an absorption tower filled with an aqueous $K_2CO_3$ solution, at where only $CO_2$ gas was selectively removed to obtain six exhaust gases having $CO/CO_2$ ratios of 4.3, 6.2, 7.5, 9.5, 10.2 and 10.9. By using each of these exhaust gases as the shrouding gas at a flow amount of CO corresponding to 12% or 7% of the flow amount of $O_2$ gas, the same blowing operation as described above was continuously repeated by 5 charges every the predetermined $CO/CO_2$ ratio, and thereafter an average amount of tuyere wear per charge was measured to obtain a result as shown in FIG. 4 together with the result using 0.15 $Nm^3$/min of propane gas (corresponding to 4.3% of the flow amount of $O_2$ gas).

Figure 4:
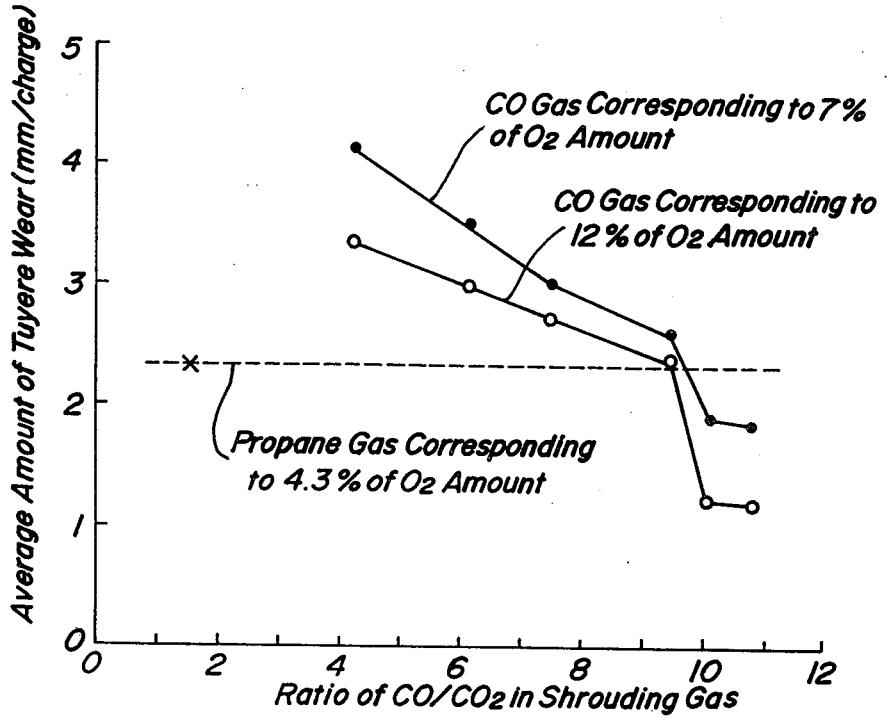
FIG. 4 is a graph showing a relation between the ratio $CO/CO_2$ in the shrouding gas and the amount of tuyere wear.

As apparent from FIG. 4, it is necessary to retain the ratio of $CO/CO_2$ in the converter exhaust gas to not less than 10 irrespective of the flow amount of CO in order to provide the effect of tuyere protection equal to that of the propane gas. In this case, when the flow amount of CO to $O_2$ gas is less than 5%, it is difficult to provide the effect of tuyere protection equal to that of the propane gas, while when the flow amount of CO exceeds 20%, the effect of tuyere protection is achieved but the heat balance in the converter is deteriorated uneconomically, so that it is desirable that the flow amount of CO to $O_2$ gas is about 5~20%.

Moreover, the hydrogen content of molten steel sampled at the blow end was about 1.8±0.3 ppm according to the present invention and 5.2±1.2 ppm in the case of using the propane gas.

EXAMPLE 3

Into the illustrated converter was charged a molten pig iron having the following chemical composition on weight ratio:

| | | | |
|---|---|---|---|
| C: | 4.2%, | Si: | 0.36%, |
| Mn: | 0.41%, | P: | 0.10%, |
| S: | 0.036%. | | |

The temperature of the molten pig iron was 1,290° C.

During the charging, nitrogen gas was flowed into each of the tuyeres 5 at an amount of 1.25 $Nm^3$/min in case of the inner pipe 6 and 0.23 $Nm^3$/min in case of the outer pipe 7 in order to prevent the clogging of these pipes. Immediately after the charging, the converter was turned in the perpendicular state to perform the following runs.

[Run No. 9]

In the tuyeres 5, 1.25 $Nm^3$/min of $O_2$ gas was supplied to the inner pipe 6. On the other hand, the converter exhaust gas having a regulated composition of 84%CO—5%$CO_2$—8%$N_2$—3%$H_2$ was supplied to each of the two inner pipes 7 in a-group tuyeres 5 at an amount of 0.25 $Nm^3$/min corresponding to 20% of the amount of $O_2$ gas blown from the bottom, while 0.10 $Nm^3$/min of propane gas was supplied to each of the two inner pipes 7 in b-group tuyeres 5. Further, a top-blown lance was inserted into the converter, through which 5 $Nm^3$/min of $O_2$ gas was blown to the bath surface of molten pig iron to supplement the amount of $O_2$ gas blown from the bottom. At the same time as starting the blowing, 150 kg of burnt lime was added from the top of molten pig iron. The blowing was continued for about 20 minutes.

Thereafter, the lance was pulled up from the converter and at the same time the blowing in the each tuyere 5 was changed to the feeding of $N_2$ gas as described above. Subsequently, the converter was inclined to the charging side to conduct the measurement of molten steel temperature and the sampling, whereby the following results were obtained:

| | | | |
|---|---|---|---|
| C: | 0.02%, | Mn: | 0.24%, |
| Si: | trace, | P: | 0.015%, |
| S: | 0.021%, | | |
| | Molten steel temperature: 1,660° C. | | |

Then, the converter was inclined to a tapping side and molten steel was taken out to a ladle, after which the converter was again inclined to the charging side to remove molten slag. Thus, after the converter was emptied and the feeding of $N_2$ gas was stopped, the inspection plug 16 located just beneath the inner pipe was removed to measure the amount of tuyere wear in the same manner as described in Example 1. As a result, the amount of tuyere wear in the a-group tuyeres using the converter exhaust gas according to the present invention was 1.6 mm and 1.9 mm on one charge, while the amount of tuyere wear in the b-group tuyeres using the propane gas was 2.3 mm and 2.4 mm.

Although the amount of the exhaust gas used as the shrouding gas in this run is 20%, when the amount of the exhaust gas used is varied within a range of 15–20% as mentioned later, the effect of preventing tuyere wear is excellent as compared with the case of using propane gas at the usual amount.

[Run No. 10]

In the tuyeres 5, 1.25 $Nm^3$/min of $O_2$ gas was supplied to the inner pipe 6. On the other hand, the converter exhaust gas having the same composition as in the run No. 9 was supplied to each of the inner pipes 7 in a- and b-group tuyeres 5 at an amount of 0.19 $Nm^3$/min corresponding to 15% of the amount of $O_2$ gas blown from the bottom, whereby only the bottom blowing was repeated by 5 charges. Thereafter, the amount of tuyere wear was measured to be 1.9~2.1 mm/charge, which exhibited the effect of preventing tuyere wear equal to or more than that of the propane gas. In this case, however, the nitrogen content in molten steel was 28 ppm, which was higher by about 5~10 ppm than that of the usual case using propane gas. The resulting molten steel having such a high nitrogen content cannot be applied to steel products requiring a lower nitrogen content.

[Run No. 11]

In order to realize the effect of tuyere protection equal to that of the propane gas and to make the nitrogen content of molten steel to not more than about 20 ppm raising no trouble in the quality of usual products, the relation among nitrogen content of molten steel, nitrogen concentration of shrouding gas and flow amount of $O_2$ gas was examined by changing the nitrogen concentration of the converter exhaust gas as the shrouding gas into various values.

The experiment was made by changing the flow amount of $O_2$ gas in the bottom blowing or the top and bottom blowing under such a condition that the total flow amount of $O_2$ gas was maintained at 10 $Nm^3$/min. In this case, the flow amount of the converter exhaust gas was retained within a range of 15~20% to the flow amount of $O_2$ gas blown from the bottom. Moreover, when the ratio of flow amount of $O_2$ gas blown from bottom to total flow amount of $O_2$ gas was 0.1, three tuyeres among four tuyeres 5 were plugged. The thus obtained experimental results are shown in FIG. 5.

Figure 5:
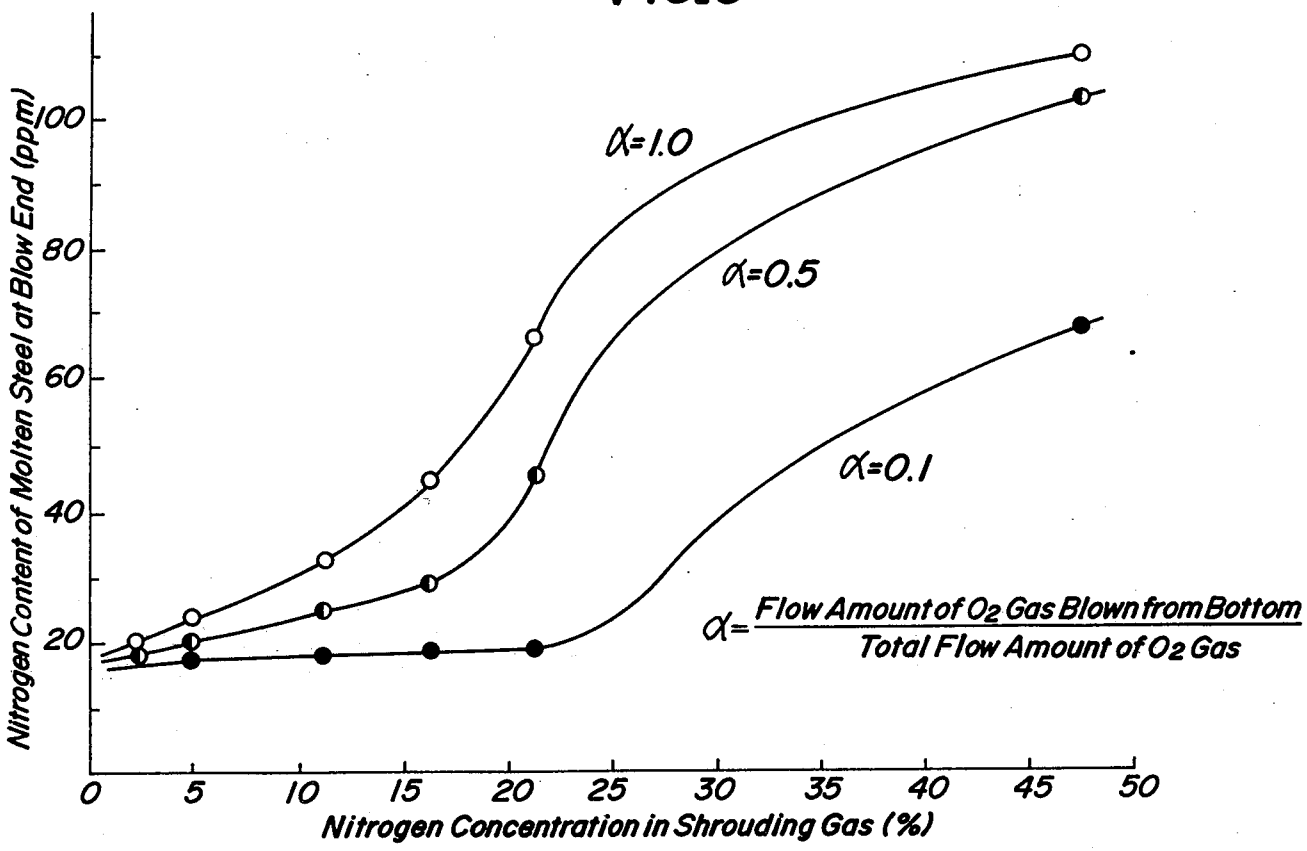
FIG. 5 is a graph showing a relation between the nitrogen content in molten iron after the completion of the blowing and the nitrogen concentration in the shrouding gas.

As apparent from FIG. 5, the nitrogen content of molten steel is dependent upon the ratio of flow amount of $O_2$ gas blown from bottom to total flow amount of $O_2$ gas and the nitrogen concentration of the converter exhaust gas as a shrouding gas. Therefore, in order to obtain the nitrogen content of not more than 20 ppm raising no trouble in the quality of usual molten steel, it can be seen that the nitrogen concentration of the converter exhaust gas is sufficient to be not more than 2.5% in case of 100% bottom blowing of $O_2$ gas, not more than 5% in case of 50% bottom blowing of $O_2$ gas, and not more than 25% in case of 10% bottom blowing of $O_2$ gas.

Moreover, the hydrogen content of molten steel sampled at the blow end was 1.3~2.0 ppm according to the present invention and about 4.5±1.2 ppm in the case of using the propane gas.

[Run No. 12]

The same procedure as described in the run No. 9 was repeated except that the shrouding gas was passed through all tuyeres at a flow amount of 15~20% to the flow amount of $O_2$ gas blown from the bottom, wherein the converter exhaust gas having a chemical composition of CO:80~92%, $CO_2$:3~6%, $N_2$:6~9% and $H_2$:3~4% was used as the shrouding gas without removing nitrogen in the initial blowing stage and then exchanged into the converter exhaust gas in which nitrogen was removed to a concentration of 2~5% in the course of the blowing. Moreover, the temperature of molten steel at blow end was 1,630°~1,690° C., and the carbon content thereof at blow end was 0.02~0.35%.

In the above operation, the exchange time of the shrouding gas was examined to obtain a result as shown in FIG. 6 showing a relation between decarburization amount ΔC on the blowing period with the low-nitrogen converter exhaust gas according to the present invention (ΔC=carbon content of molten steel at the exchange time of shrouding gas—carbon content of molten steel or blow end) and the nitrogen content of molten steel at blow end.

As apparent from FIG. 6, the decarburization amount ΔC is closely related to the nitrogen content of molten steel at blow end, so that the exchange of shrouding gas is sufficient to be performed when the carbon content of molten steel reaches at least 1.0% higher than that at blow end.

EXAMPLE 4

Into the illustrated converter has charged a molten pig iron having the following chemical composition on weight ratio:

| | | | |
|---|---|---|---|
| C: | 4.5%, | Si: | 0.36%, |
| Mn: | 0.45%, | P: | 0.11%, |
| S: | 0.03%. | | |

The temperature of the molten pig iron was 1,270° C.

During the charging, nitrogen gas was flowed into each of the tuyeres 5 at an amount of 1.25 $Nm^3$/min in case of the inner pipe 6 and 0.23 $Nm^3$/min in case of the outer pipe 7 in order to prevent the clogging of these pipes. Immediately after the charging, the converter was turned in the perpendicular state and the blowing was performed as follows.

In the tuyeres 5, 1.25 $Nm^3$/min of $O_2$ gas was supplied to the inner pipe 6. On the other hand, an exhaust gas of the blast furnace obtained by adjusting the ratio $C_{CO}/C_{CO_2}$ to 11.5 and the nitrogen concentration to 4% was supplied to each of the two inner pipes 7 in a-group tuyeres 5 in such a manner that CO gas was flowed at an amount of 0.125 $Nm^3$/min corresponding to 10% of the flow amount of $O_2$ gas, while 0.05 $Nm^3$/min of propane gas was supplied to each of the two inner pipes 7 in b-group tuyeres 5. Further, a top-blown lance was inserted into the converter, through which 5 $Nm^3$/min of $O_2$ gas was blown to the bath surface of molten pig iron to supplement the amount of $O_2$ gas blown from the bottom. At the same time as starting the blowing, 150 kg of burnt lime was added from the top to molten pig iron. The blowing was continued for about 20 minutes.

Thereafter, the lance was pulled up from the converter and at the same time the blowing of $O_2$ gas in the each tuyere 5 was changed to the feeding of $N_2$ gas as described above. Subsequently, the converter was inclined to the charging side to conduct the measurement of molten steel temperature and the sampling, whereby the following results were obtained:

| | | | |
|---|---|---|---|
| C: | 0.02%, | Mn: | 0.21%, |
| Si: | trace, | P: | 0.011%, |
| S: | 0.014%, | N: | 18 ppm, |
| Molten steel temperature: 1,674° C. | | | |

Then, the converter was inclined to a tapping side and molten steel was taken out to a ladle, after which the converter was again inclined to the charging side to remove molten slag. Thus, after the converter was emptied and the feeding of $N_2$ gas was stopped, the inspection plug 16 located just beneath the inner pipe was removed to measure the amount of tuyere wear in the same manner as described in Example 1. As a result, the amount of tuyere wear in the a-group tuyeres using the blast furnace exhaust gas according to the present invention was 1.3 mm and 1.6 mm on one charge, while the amount of tuyere wear in the b-group tuyeres using the propane gas was 2.3 mm and 2.4 mm.

From the above experiment, it has been found that the effect of preventing the tuyere wear is considerably excellent in the case of using the blast furnace exhaust gas as compared with the usual amount of propane gas used, and also the nitrogen content of molten steel is sufficiently low.

Then, the following runs were made with respect to the ratio of $CO/CO_2$ in the blast furnace exhaust gas capable of realizing the protection performance equal to that of the propane gas. That is, the blast furnace exhaust gas having a chemical composition of 28%CO—19%$CO_2$—50%$N_2$—3%$H_2$ was passed through an absorption tower filled with an aqueous $K_2CO_3$ solution, at where only $CO_2$ gas was selectively removed to obtain six exhaust gases having $CO/CO_2$ ratios of 1.5, 5.8, 7.6, 9.0, 10.3 and 11.5. By using each of these exhaust gases as the shrouding gas at a flow amount of CO corresponding to 15% of the flow amount of $O_2$ gas, the same blowing operation as described above was continuously repeated by 5 charges every the predetermined $CO/CO_2$ ratio, and thereafter the amount of tuyere wear and the nitrogen content of molten steel were measured to obtain a result as shown in the following Table 4. For the reference, the above result using the propane gas is also shown in Table 4.

TABLE 4

| Run No. | Kind of shrouding gas | CO concentration (%) | $CO_2$ concentration (%) | $N_2$ concentration (%) | Flow amount of shrouding gas per tuyere ($Nm^3$/min) | Amount of tuyere wear (mm/charge) | Nitrogen content of molten steel (ppm) |
|---|---|---|---|---|---|---|---|
| 13 | A | 28 | 19 | 50 | 0.67 | 4.8 | 120 |
| 14 | B | 32.3 | 5.6 | 57.8 | 0.58 | 3.6 | 134 |
| 15 | C | 32.8 | 4.3 | 58.6 | 0.57 | 2.9 | 129 |
| 16 | D | 33.3 | 3.7 | 58.8 | 0.57 | 2.5 | 137 |
| 17 | E | 32.8 | 3.2 | 59.6 | 0.56 | 1.8 | 135 |

TABLE 4-continued

| Run No. | Kind of shrouding gas | CO concentration (%) | $CO_2$ concentration (%) | $N_2$ concentration (%) | Flow amount of shrouding gas per tuyere ($Nm^3$/min) | Amount of tuyere wear (mm/charge) | Nitrogen content of molten steel (ppm) |
|---|---|---|---|---|---|---|---|
| 18 | F | 33.4 | 2.9 | 60.1 | 0.54 | 1.7 | 138 |
| | propane | — | — | — | 0.05 | 2.0 | 15 |

As apparent from Table 4, it is necessary to retain the ratio of $CO/CO_2$ in the blast furnace exhaust gas to not less than 10 irrespective of the flow amount of CO in order to provide the effect of tuyere protection equal to that of the propane gas likewise the case of using the converter exhaust gas as previously mentioned. However, the nitrogen content of molten steel cannot be reduced only by adjusting the ratio $CO/CO_2$ in the blast furnace exhaust gas to not less than 10 as apparent from Table 4.

[Run No. 19]

In order to realize the effect of tuyere protection equal to that of the propane gas and to make the nitrogen content of molten steel to not more than about 20 ppm raising no trouble in the quality of usual products when using the blast furnace exhaust gas as a shrouding gas, the relation among nitrogen content of molten steel, nitrogen concentration of shrouding gas and flow amount of $O_2$ gas was examined by changing the nitrogen concentration of the blast furnace exhaust gas into various values after the ratio of $CO/CO_2$ in the exhaust gas was adjusted to not less than 10.

The experiment was made by changing the flow amount of $O_2$ gas in the bottom blowing or the top and bottom blowing under such a condition that the total flow amount of $O_2$ gas was maintained at 10 $Nm^3$/min. In this case, the flow amount of the blast furnace exhaust gas was retained within a range of 15~28% to the flow amount of $O_2$ gas blown from the bottom (the flow amount of CO gas was 14%). Moreover, when the ratio of flow amount of $O_2$ gas blown from bottom to total flow amount of $O_2$ gas was 0.1, three tuyeres among four tuyeres 5 were plugged. The thus obtained experimental results are shown in FIG. 5, which is the same as in the run No. 11 of Example 3.

As apparent from FIG. 5, the nitrogen content of molten steel is dependent upon the ratio of flow amount of $O_2$ gas blown from bottom to total flow amount of $O_2$ gas and the nitrogen concentration of the blast furnace exhaust gas as a shrouding gas. Therefore, in order to obtain the nitrogen content of not more than 20 ppm raising no trouble in the quality of usual molten steel, it can be seen that the nitrogen concentration of the blast furnace exhaust gas is preferably controlled together with the $CO_2$ concentration thereof as mentioned above and is sufficient to be not more than 2.5% in case of 100% bottom blowing of $O_2$ gas, not more than 5% in case of 50% bottom blowing of $O_2$ gas, and not more than 25% in case of 10% bottom blowing of $O_2$ gas.

Moreover, the hydrogen content of molten steel sampled at the blow end was 2.0±0.3 ppm according to the present invention and about 5.2±1.3 ppm in the case of using the propane gas.

[Run No. 20]

The same procedure as described in the run No. 19 was repeated except that the CO gas was passed as the shrouding gas through all tuyeres at a flow amount of 10~15% to the flow amount of $O_2$ gas blown from the bottom, wherein the blast furnace exhaust gas having a chemical composition of CO:32~40%, $CO_2$:2~3%, $N_2$:52~60% and $H_2$:1~4% was used as the shrouding gas in the initial blowing stage and then exchanged into the blast furnace exhaust gas in which nitrogen was removed to a concentration of 2~5% in the course of the blowing. Moreover, the temperature of molten steel at blow end was 1,590°~1,670° C., and the carbon content thereof at blow end was 0.02~0.10%.

In the above operation, the exchange time of the shrouding gas was examined to obtain the same result as shown in Example 3 shown in FIG. 6. As apparent from FIG. 6, the exchange of shrouding gas is sufficient to be performed when the carbon content of molten steel reaches at least 1.0% higher than that at blow end.

As mentioned above, the present invention is applied not only to the cooling of the concentric tuyere but also to pipes for injection of protecting fluid usually equipped with the oxygen gas blowing pipe.

According to the present invention, the effective cooling of the tuyere can be achieved even when performing the refining of molten iron bath by setting the tuyere at any position beneath molten iron surface. Furthermore, according to the present invention, the wear of tuyere top end as well as the surrounding bricks is prevented without hydrogen pick-up, whereby the protection of the tuyere can be achieved advantageously.

What is claimed is:

1. A method for protecting tuyeres for refining a molten iron which penetrate a wall of a refining vessel and through which a refining gas flow consisting of oxygen gas or a gas containing oxygen is blown together with a shrouding gas flow surrounding the refining gas flow into a molten iron charged in a refining vessel, which comprises supplying a carbon monoxide-containing gas so as to satisfy the following equation $$q_c \geqq 4.8 q_o / x$$

wherein x shows a concentration (%) of carbon monoxide in the shrouding gas, $q_c$ shows an amount ($Nm^3$/hr) of the shrouding gas flowed and $q_o$ shows an amount ($Nm^3$/hr) of oxygen gas flowed from an inner pipe, to said tuyeres as the shrouding gas.

2. The method as claimed in claim 1, wherein the tuyere is a concentric pipe in which the refining gas flows through an inner pipe and the shrouding gas flows through an outer pipe.

3. The method as claimed in claim 1, wherein the refining operation is carried out by blowing the refining gas only from the tuyeres.

4. The method as claimed in claim 1, wherein the refining operation is carried out by blowing the refining gas from the tuyeres and a top-blowing lance.

5. The method as claimed in claim 1, wherein the carbon monoxide-containing gas to be used as the shrouding gas is an exhaust gas recovered from a refining vessel or a blast furnace in an unburnt form.

6. The method as claimed in claim 5, wherein carbon dioxide in the exhaust gas is removed so as to satisfy the following equation $$C_{CO_2} \leqq 1/10 C_{CO}$$

wherein $C_{CO_2}$ shows a concentration (%) of $CO_2$ in the exhaust gas and $C_{CO}$ shows a concentration (%) of CO in the exhaust gas.

7. The method as claimed in claim 6, wherein nitrogen in the exhaust gas is removed so as to satisfy the following equation $$C_{N_2} \leqq 2.5 q_o / q_o^B$$

wherein $C_{N_2}$ shows a concentration (%) of $N_2$ in the exhaust gas, $q_o$ shows a total amount ($Nm^3$/min) of refining oxygen gas flowed and $q_o^B$ shows an amount ($Nm^3$/min) of oxygen supplied from the tuyeres.

8. The method as claimed in claim 6, wherein the exhaust gas from which nitrogen is removed so as to satisfy the following equation $$C_{N_2} \leqq 2.5 q_o / q_o^B$$

wherein $C_{N_2}$ shows a concentration (%) of $N_2$ in the exhaust gas, $q_o$ shows a total amount ($Nm^3$/min) of refining oxygen gas flowed and $q_o^B$ shows an amount ($Nm^3$/min) of oxygen supplied from the tuyeres, is supplied to the tuyeres, when a carbon content in the molten iron reaches carbon value which is at least 1.0% higher than a blow end value of carbon.

* * * * *